US011272818B2

(12) United States Patent
Yang et al.

(10) Patent No.: US 11,272,818 B2
(45) Date of Patent: Mar. 15, 2022

(54) HANDHELD CLEANER

(71) Applicant: LG ELECTRONICS INC., Seoul (KR)

(72) Inventors: Ingyu Yang, Seoul (KR); Youngsoo Kim, Seoul (KR); Kyoungho Ryou, Seoul (KR); Jinhyouk Shin, Seoul (KR); Daeho Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 331 days.

(21) Appl. No.: 16/361,373

(22) Filed: Mar. 22, 2019

(65) Prior Publication Data

US 2019/0335965 A1 Nov. 7, 2019

(30) Foreign Application Priority Data

May 3, 2018 (KR) ..... 10-2018-0051334

(51) Int. Cl.
*A47L 9/12* (2006.01)
*A47L 5/24* (2006.01)
(Continued)

(52) U.S. Cl.
CPC ..... *A47L 9/127* (2013.01); *A47L 5/24* (2013.01); *A47L 9/102* (2013.01); *A47L 9/16* (2013.01); *A47L 9/22* (2013.01); *A47L 9/322* (2013.01)

(58) Field of Classification Search
CPC ... A47L 5/24; A47L 9/102; A47L 9/12; A47L 9/127; A47L 9/16; A47L 9/22; A47L 9/322
See application file for complete search history.

(56) References Cited

U.S. PATENT DOCUMENTS 6,010,550 A * 1/2000 Song ..... A47L 9/125 55/482
8,302,250 B2 * 11/2012 Dyson ..... A47L 9/22 15/327.1
(Continued)

FOREIGN PATENT DOCUMENTS

CN C102273982 12/2011
CN 105307552 2/2016
(Continued)

OTHER PUBLICATIONS

Chinese Office Action in Chinese Appln. No. 201880092967.3, dated Jun. 11, 2021, 17 pages (with English translation).
(Continued)

*Primary Examiner* — Marc Carlson
(74) *Attorney, Agent, or Firm* — Fish & Richardson P.C.

(57) ABSTRACT

A cleaner includes a main body having an opening, a suction motor accommodated in the main body and configured to generate suction force, an opening cover separably coupled to the main body and configured to cover the opening, a motor housing configured to surround the suction motor, a flow guide disposed to surround at least a portion of the motor housing and spaced apart from the motor housing, and a filter mechanism disposed between the motor housing and the flow guide and including a filter member configured to filter dust contained in introduced air. The filter member is disposed to surround the motor housing, and the filter member includes a first filter unit and a second filter unit extends in a direction in which the first and second filter units cross each other.

20 Claims, 9 Drawing Sheets

(51) Int. Cl.

| | |
|---|---|
| ***A47L 9/10*** | (2006.01) |
| ***A47L 9/16*** | (2006.01) |
| ***A47L 9/22*** | (2006.01) |
| *A47L 9/32* | (2006.01) |

(56) References Cited

U.S. PATENT DOCUMENTS

| | | | | |
|---|---|---|---|---|
| 2010/0011533 | A1 | 1/2010 | Ryan | |
| 2011/0219570 | A1 | 9/2011 | Conrad | |
| 2011/0219577 | A1 | 9/2011 | Conrad | |
| 2016/0174788 | A1 | 6/2016 | Conrad | |
| 2017/0280950 | A1* | 10/2017 | Nam | A47L 9/2884 |
| 2017/0280951 | A1* | 10/2017 | Nam | A47L 9/1616 |
| 2017/0280952 | A1* | 10/2017 | Nam | A47L 9/1608 |
| 2017/0280959 | A1* | 10/2017 | Nam | A47L 9/1641 |
| 2017/0296958 | A1 | 10/2017 | Nam et al. | |
| 2017/0332860 | A1* | 11/2017 | Nam | A47L 9/1641 |
| 2018/0055301 | A1 | 3/2018 | Conrad et al. | |
| 2018/0055320 | A1* | 3/2018 | Hwang | A47L 9/1683 |
| 2018/0333022 | A1 | 11/2018 | Nam et al. | |
| 2018/0333023 | A1 | 11/2018 | Nam et al. | |
| 2018/0333024 | A1 | 11/2018 | Nam et al. | |
| 2018/0333025 | A1 | 11/2018 | Nam et al. | |
| 2018/0333026 | A1 | 11/2018 | Nam et al. | |
| 2018/0333029 | A1 | 11/2018 | Nam et al. | |
| 2018/0333030 | A1 | 11/2018 | Nam et al. | |
| 2018/0333031 | A1 | 11/2018 | Nam et al. | |
| 2018/0333032 | A1 | 11/2018 | Nam et al. | |
| 2018/0333033 | A1 | 11/2018 | Nam et al. | |

FOREIGN PATENT DOCUMENTS

| | | |
|---|---|---|
| JP | 3144485 | 3/2001 |
| JP | 2003284906 | 10/2003 |
| KR | 2020000004993 | 3/2000 |
| KR | 1020050064938 | 6/2005 |
| KR | 10-1127088 | 3/2012 |
| KR | 101119118 | 3/2012 |
| KR | 101122688 | 3/2012 |
| KR | 2020140003914 | 6/2014 |
| KR | 1020180023776 | 3/2018 |

OTHER PUBLICATIONS

Korean Office Action in Korean Appln. No. 10-2018-0051334, dated Apr. 1, 2021, 11 pages (with English translation).

* cited by examiner

HANDHELD CLEANER

CROSS-REFERENCE TO RELATED APPLICATIONS

The present application claims priority under 35 U.S.C. 119 and 35 U.S.C. 365 to Korean Patent Application No. 10-2018-0051334, filed on May 3, 2018, which is hereby incorporated by reference in its entirety.

BACKGROUND

The present disclosure relates to a cleaner.

A cleaner is a device that performs cleaning by suctioning and wiping dust or foreign substances on a surface to be cleaned.

Cleaners may be classified into a manual cleaner that a user moves in person for cleaning and an automatic cleaner that automatically moves for cleaning.

Manual cleaners may fall into, depending on the types, a canister cleaner, an upright cleaner, a handy cleaner, and a stick cleaner.

A hand-held vacuum cleaner is disposed in Korean patent Publication No. 10-1127088 (Mar. 8, 2012) that is prior art document.

The hand-held vacuum cleaner may include a suction tube, an air flow generator, a centrifugal separation device, a power source, and a handle.

The air flow generator is disposed in a motor housing and a shape of a motor and fan assembly. A pre-motor filter may be disposed at the front of the air flow generator, and a post-motor filter may be disposed at the rear of the air flow generator.

When the motor of the hand-held vacuum cleaner is driven, an air flow may be generated along the suction tube, and air existing around a target area to be cleaned may be suctioned through a suction hole.

Foreign substance contained in the air suctioned through the suction hole may be collected into an upstream cyclone by the centrifugal separation device. Also, the air that is partially cleaned by the upstream cyclone may be introduced into a downstream cyclone. In the downstream cyclone, foreign substances having a particle size less than that of the foreign substances collected in the upstream cyclone may be separated.

The foreign substances remaining in the air passing through the downstream cyclone may be discharged from the centrifugal separation device and be filtered again while successively passing through the pre-motor filter and the post-motor filter and then discharged to the outside of the hand-held vacuum cleaner.

Here, to prevent the foreign substances, which are not separated from the upstream and downstream cyclones from being discharged to the outside, foreign substance filtering performance of the pre-motor filter and the post-motor filter is important.

Also, as a cleaning time is accumulated, the foreign substances may be accumulated on the filter. The foreign substances accumulated on the filter may act as flow resistance on a passage of the cleaner to deteriorate suction performance of the cleaner. Thus, to reduce the deterioration of the suction performance of the cleaner, it is necessary to sufficiently secure an area of the filter.

In case of the related art, to increase the area of the filter, it is necessary to increase a size of a space in which each filter is accommodated. Therefore, there is a limitation that an internal structure of the hand-held vacuum cleaner has to be changed.

SUMMARY

Embodiments provide a cleaner in which discharge of foreign substances is capable of being reduced.

Embodiments also provide a cleaner in which foreign substance filtering performance is capable of being improved without changing a structure of a cleaner body.

Embodiments also provide a cleaner in which deterioration of suction performance according to accumulation of a cleaning time is capable of being reduced.

In one embodiment, a cleaner includes: a main body having an opening; a suction motor accommodated in the main body and configured to generate suction force; an opening cover separably coupled to the main body and configured to cover the opening; a motor housing configured to surround the suction motor; a flow guide disposed to surround at least a portion of the motor housing and spaced apart from the motor housing; and a filter mechanism disposed between the motor housing and the flow guide and including a filter member configured to filter dust contained in introduced air The filter member is disposed to surround the motor housing, and the filter member includes: a first filter unit; and a second filter unit extending in a direction in which the first and second filter units cross each other.

In another embodiment, a cleaner includes: a main body having an opening; a suction motor accommodated in the main body and configured to generate suction force; an opening cover separably coupled to the main body and configured to cover the opening; a motor housing configured to surround the suction motor; and a filter mechanism including a filter member configured to filter dust contained in air flowing to the suction motor.

The filter member includes: an upper body having a central opening; an upper filter unit disposed on the central opening of the upper body; and a side filter unit connected to a lower portion of the upper body, and the opening cover includes a top surface part facing the upper filter unit.

At least a portion of the upper body is spaced apart from the top surface part, and the upper filter unit is spaced apart from the top surface part.

The details of one or more embodiments are set forth in the accompanying drawings and the description below. Other features will be apparent from the description and drawings, and from the claims.

DETAILED DESCRIPTION OF THE EMBODIMENTS

Figure 1:
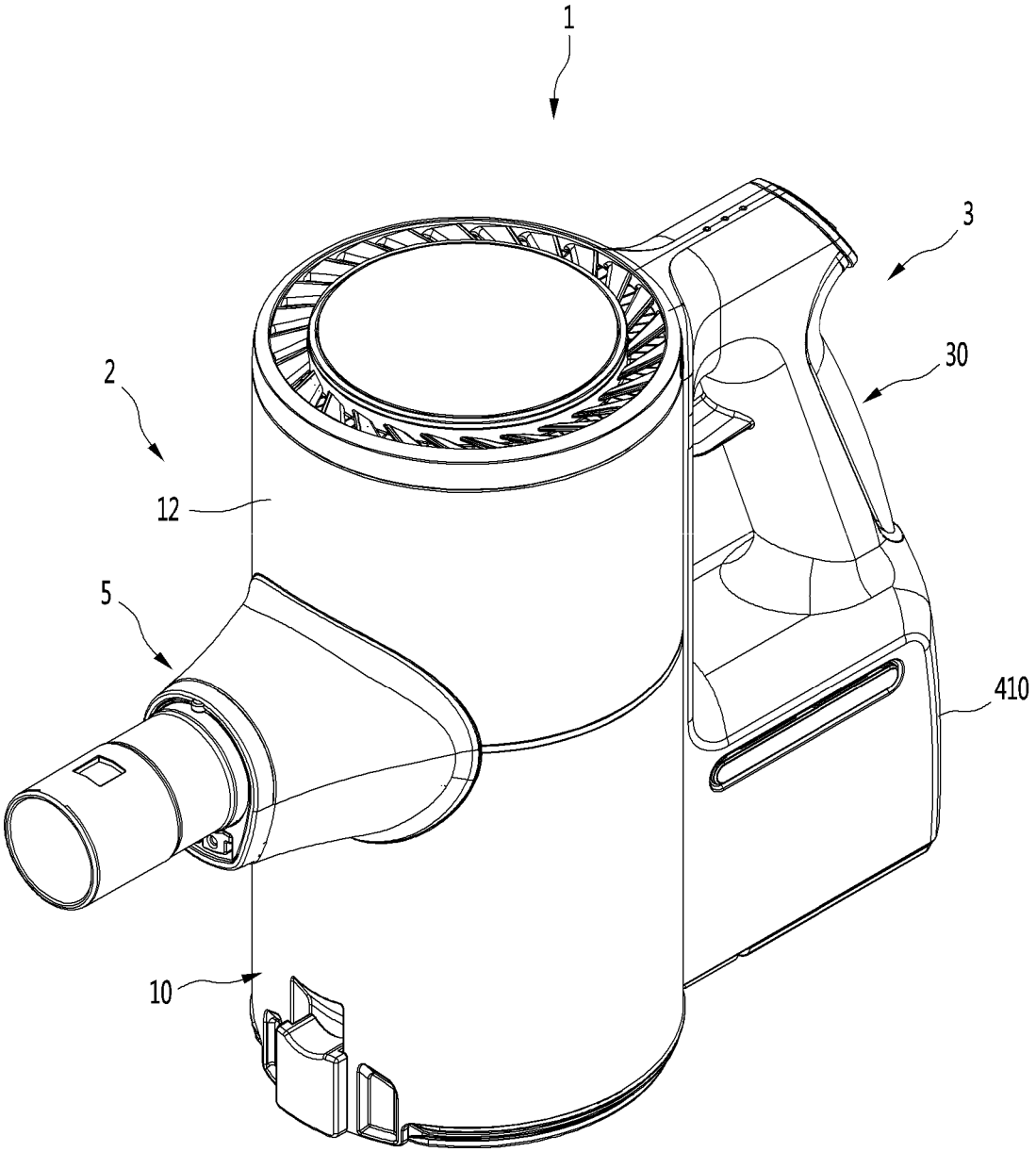
FIG. 1 is a perspective view of a cleaner according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", "coupled" or "joined" to the latter with a third component interposed therebetween.

[Constituent of Cleaner]

Figure 2:
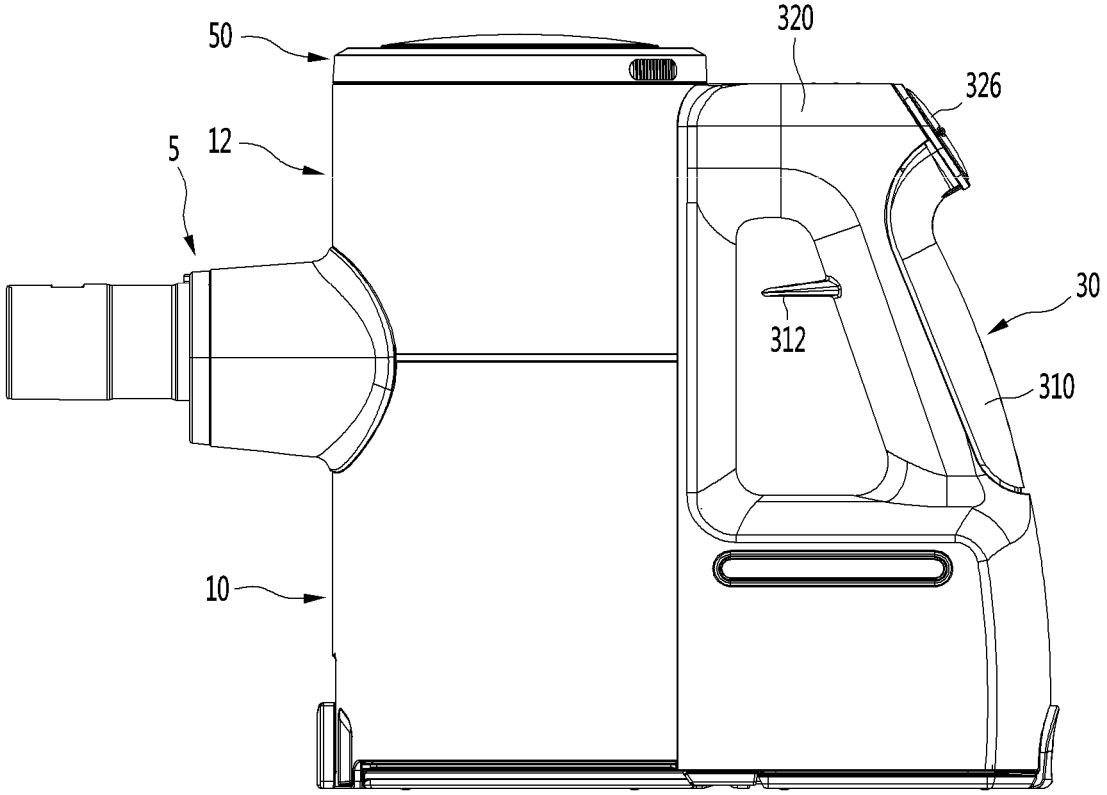
FIG. 2 is a side view of the cleaner according to an embodiment.
Figure 3:
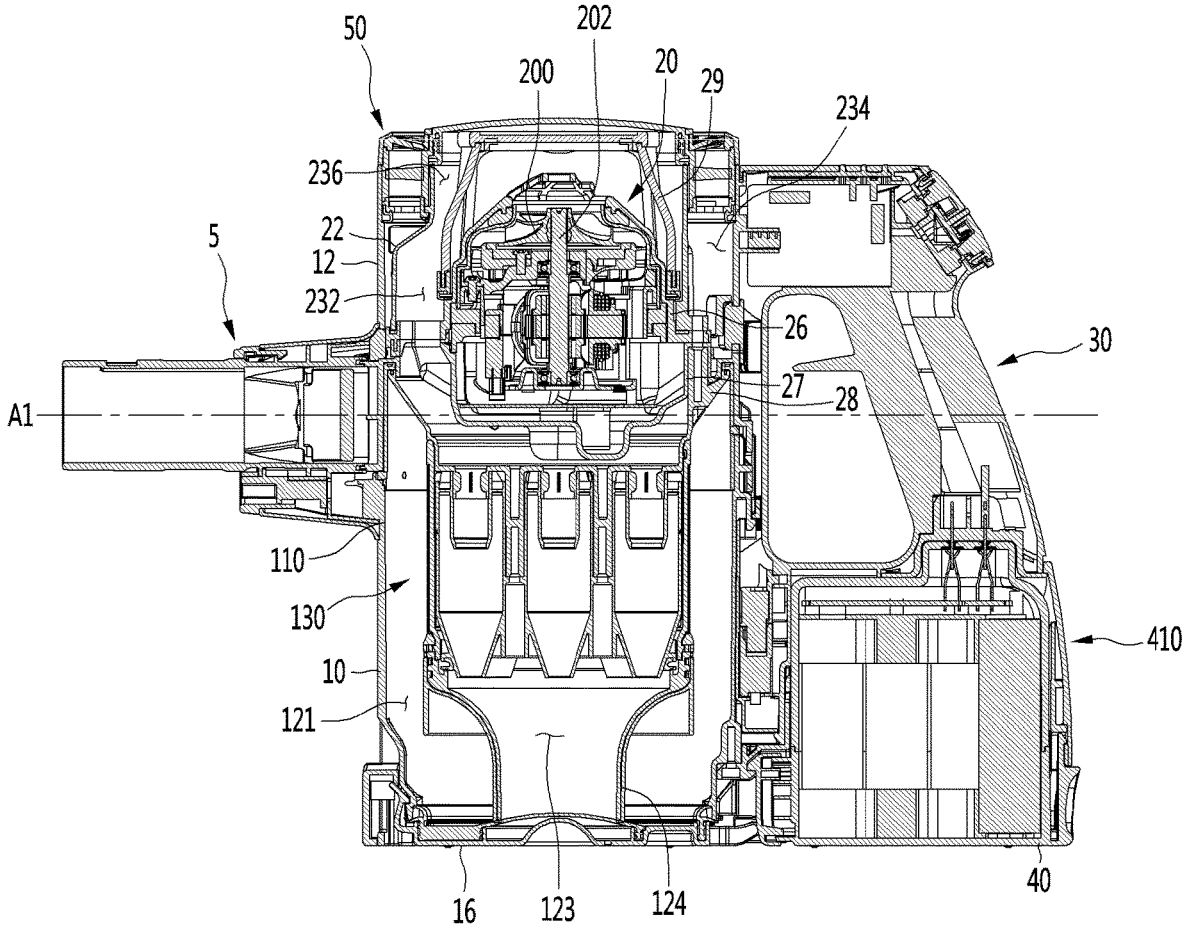
FIG. 3 is a longitudinal cross-sectional view of the cleaner according to an embodiment.

FIG. 1 is a perspective view of a cleaner according to an embodiment, FIG. 2 is a side view of the cleaner according to an embodiment, and FIG. 3 is a longitudinal cross-sectional view of the cleaner according to an embodiment.

Referring to FIGS. 1 to 3, a cleaner 1 according to an embodiment may include a main body 2.

The cleaner 1 may further include a suction inlet 5 coupled to the front of the main body 2. The suction inlet 5 can guide air containing dust into the main body 2.

The cleaner 1 may further include a handle unit 3 coupled to the main body 2. The handle unit 3 may be positioned opposite to the suction inlet 5 on the main body 2. That is, the main body 2 may be disposed between the suction inlet 5 and the handle unit 3.

The main body 2 may include a first body 10 and a second body 12 on the first body 10. The first body 10 and the second body 12 may be directly combined or may be indirectly combined through an intermediate member.

Directions of the cleaner 1 according to an embodiment will be defined. A direction in which the suction inlet 5 is disposed with respect to the main body 2 is defined as a front side, and a direction in which the handle 30 is disposed with respect to the main body 2 is defined as a rear side. Also, a direction in which the first body 10 is disposed with respect to the main body 2 is defined as an upper side. Also, a direction in which the second body 12 is disposed with respect to the main body 2 is defined as a lower side.

The first body 10 and the second body 12 may be, though not limited thereto, formed in a cylindrical shape.

The first body 10 and the second body 12 are open at the top and the bottom, respectively. That is, the bodies 10 and 12 may have a top opening and a bottom opening, respectively.

The suction inlet 5 may be coupled to the main body 2 such that the center of the suction inlet 5 is positioned approximately at the boundary between the first body 10 and the second body 12.

The main body 2 may further include a dust separation unit that separates dust from air suctioned through the suction inlet 5.

The dust separation unit may include a first cyclone unit 110 that can separate dust, for example, using cyclonic flow. The first body 10 includes the first cyclone unit 110 in this configuration. The air and dust suctioned through the suction inlet 5 helically flow along the inner side of the first cyclone unit 110. The axis of the cyclonic flow in the first cyclone unit 110 may vertically extend.

The dust separation unit may further include a second cyclone unit 130 that separates foreign substances again from the air discharged in the first cyclone unit 110. The second cyclone unit 130 may be disposed in the first cyclone unit 110.

Thus, the dust separation unit may be reduced in size to realize a more compact outer appearance of the cleaner. The second cyclone unit 130 may include a plurality of cyclone bodies that are disposed in parallel to each other.

For another example, the dust separation unit may include a single cyclone unit. In this case, an axis of the cyclone flow may vertically extend.

The first body 10 perform a storage function (or a dust container function) of storing the foreign substances separated in each of the cyclone units 110 and 130.

The main body 2 may further a body cover 16 opening and closing a lower side of the first body 10. The body cover 16 may open and close the first body 10 through a rotation operation thereof.

At least a portion of the second cyclone unit 130 may be disposed in the first body 10.

A dust storage guide 124 guiding the storage of the foreign substances separated in the second cyclone unit 130 may be disposed in the first body 10. The dust storage guide 124 may be coupled to a lower portion of the second cyclone unit 130 to contact a top surface of the body cover 16.

The dust storage guide 124 may partition an inner space of the first body 10 into a first dust storage part 121 storing the dusts separated in the first cyclone unit 110 and a second storage part 123 storing the dusts separated in the second cyclone unit 130.

An inner space of the dust storage guide 124 may be the second dust storage part 123, and a space between the dust storage guide 124 and the first body 10 may be the first dust storage part 121. The body cover 16 may open and close the first dust storage part 121 and the second dust storage part 123 together with each other.

The cleaner 1 may further include a suction motor 20 for generating suction force and a battery 40 for supplying power to the suction motor 20. The suction motor 20 may be disposed in the second body 12. At least a portion of the suction motor 20 may be disposed over the dust separation unit. The suction motor 20 is disposed over the first body 10.

The cleaner 1 may further include a discharge guide 28 communicated with the second cyclone unit 130 and a flow guide 22 that communicates with the discharge guide 28.

For example, the discharge guide 28 is disposed on the second cyclone unit 130 and the flow guide 22 is disposed over the discharge guide 28. Also, the suction motor 20 may be disposed in the flow guide 22. Thus, the axis of the cyclone flow of the dust separation unit may pass through the suction motor 20.

Since the suction motor 20 is disposed above the second cyclone unit 130, the air discharged in the second cyclone unit 130 may directly flow to the suction motor 20. Thus, a passage between the dust separation unit 130 and the suction motor 20 may be minimized.

The suction motor 20 may include a rotating impeller 200. The impeller 200 may be connected to a shaft 202. The shaft 202 may be disposed to extend in a vertical direction (a vertical direction of FIG. 3).

An extension line (that is called a rotation axis of the impeller 200) of the shaft 232 may pass through the first body 10. Here, the rotation axis of the impeller 200 and the axis of the cyclone flow generated in the first cyclone unit 110 of the dust separation unit may be disposed in the same line. According to an embodiment, a flow path of air discharged from the dust separation unit, i.e., air discharged upward from the second cyclone unit 130 toward the suction motor 20 may be reduced to reduce a change in flow direction of the air. Thus, a flow loss of the air may be reduced. When the flow loss of the air is reduced, suction force may increase. Also, a use time of a battery 40 supplying power to the suction motor 20 may increase.

The cleaner 1 may further include a motor housing accommodating the suction motor 20. The motor housing may include an upper motor housing 26 covering a portion of an upper side of the suction motor 20 and a lower motor housing 27 covering a portion of a lower side of the suction motor 20. The suction motor 20 may be accommodated in each of the motor housings 26 and 27, and the flow guide 22 may be disposed to surround the upper motor housing 26.

At least a portion of the flow guide 22 may be spaced apart from the upper motor housing 26. Also, at least a portion of the flow guide 22 may be spaced apart from the second body 12. Thus, an inner circumferential surface of the flow guide 22 and an outer circumferential surface of the upper motor housing 26 may provide a first air passage 232, and an outer circumferential surface of the flow guide 22 and an inner circumferential surface of the second body 12 may provide a third air passage 234.

The air discharged from the second cyclone unit 130 flows to the suction motor 20 through the first air passage 232 and the air discharged from the suction motor 20 flows through the third air passage 234 and is then discharged outside. Accordingly, the third air passage 234 functions as an exhaust channel.

The handle unit 3 may include a handle 30 for a user to hold and a battery housing 410 under the handle 30. The handle 30 may be disposed behind the suction motor 20.

The battery 40 may be disposed behind the first body 10. Accordingly, the suction motor 20 and the battery 40 may be arranged not to vertically overlap each other and may be disposed at different heights.

According to this embodiment, since the suction motor 20 that is heavy is disposed ahead of the handle 30 and the battery 40 that is heavy is disposed behind the handle 30, so weight can be uniformly distributed throughout the cleaner 1. It is possible to prevent injuries to the user's wrist when a user cleans with the handle 30 in his/her hand. That is, since the heavy components are distributed at the front and rear portions and at different heights in the cleaner 1, it is possible to prevent the center of gravity of the cleaner 1 from concentrating on any one side.

Since the battery 40 is disposed under the handle 30 and the suction motor 20 is disposed in front of the handle 30, there is no component over the handle 30. That is, the top of the handle 30 forms a portion of the external appearance of the top of the cleaner 1. Accordingly, it is possible to prevent any component of the cleaner 1 from coming in contact with the user's arm while the user cleans with the handle 30 in his/her hand.

The handle 30 may include a first extension 310 extending vertically to be held by a user and a second extension 320 extending toward the suction motor 20 over the first extension 310. The second extension 320 may at least partially horizontally extend.

A stopper 312 for preventing a user's hand holding the first extension 310 from moving in the longitudinal direction of the first extension 310 (vertically in FIG. 2) may be formed on the first extension 310. The stopper 312 may extend toward the suction inlet 5 from the first extension 310.

The stopper 312 is spaced apart from the second extension 320. Accordingly, a user is supposed to hold the first extension 310, with some of the fingers over the stopper 312 and the other fingers under the stopper 312. For example, the stopper 312 may be positioned between the index finger and the middle finger.

According to this arrangement, when a user holds the first extension 310, the longitudinal axis A1 of the suction inlet 5 may pass through the user's wrist. If the longitudinal axis A1 of the suction inlet 5 passes through the user's wrist and the user's arm is stretched, the longitudinal axis A1 of the suction inlet 5 may be substantially aligned with the user's stretched arm. Accordingly, there is the advantage in this state that the user uses minimum force when pushing or pulling the cleaner 1 with the handle 30 in his/her hand.

The handle 30 may include an operation unit 326. For example, the operation unit 326 may be disposed on an inclined surface of the second extension 320. It is possible to input instructions to turn on/off the suction motor through the operation unit 326. The operation unit 326 may be disposed to face a user. The operation unit 326 may be disposed opposite to the stopper 312 with the handle 30 therebetween. The operation unit 326 may be positioned higher than the stopper 312. Accordingly, a user can easily operate the operation unit 326 with his/her thumb with the first extension 310 in his/her hand. Further, since the operation unit 390 is positioned outside the first extension 310, it is possible to prevent the operation unit 390 from being unexpectedly operated when a user cleans with the first extension 310 in his/her hand.

A display unit 322 for showing operational states may be disposed on the second extension 320. The display unit 320 may be, for example, disposed on the top of the second extension 320.

The display unit 322, though not limited, may include a plurality of light emitting devices. The light emitting devices may be spaced apart from each other in the longitudinal direction of the second extension 320. The display 322, for example, can show the remaining capacity of the battery 40 and the intensity of the suction motor. The battery housing 410 may be disposed under the first extension 310. The battery 40 may be detachably received in the battery housing 410. For example, the battery 40 may be inserted into the battery housing 60 from under the battery housing 410.

The rear side of the battery housing 60 and the rear side of the first extension 310 may form a continuous surface. Accordingly, the battery housing 60 and the first extension 310 can be shown like a single unit.

<Opening Cover and Filter Mechanism of Cleaner>

Figure 4:
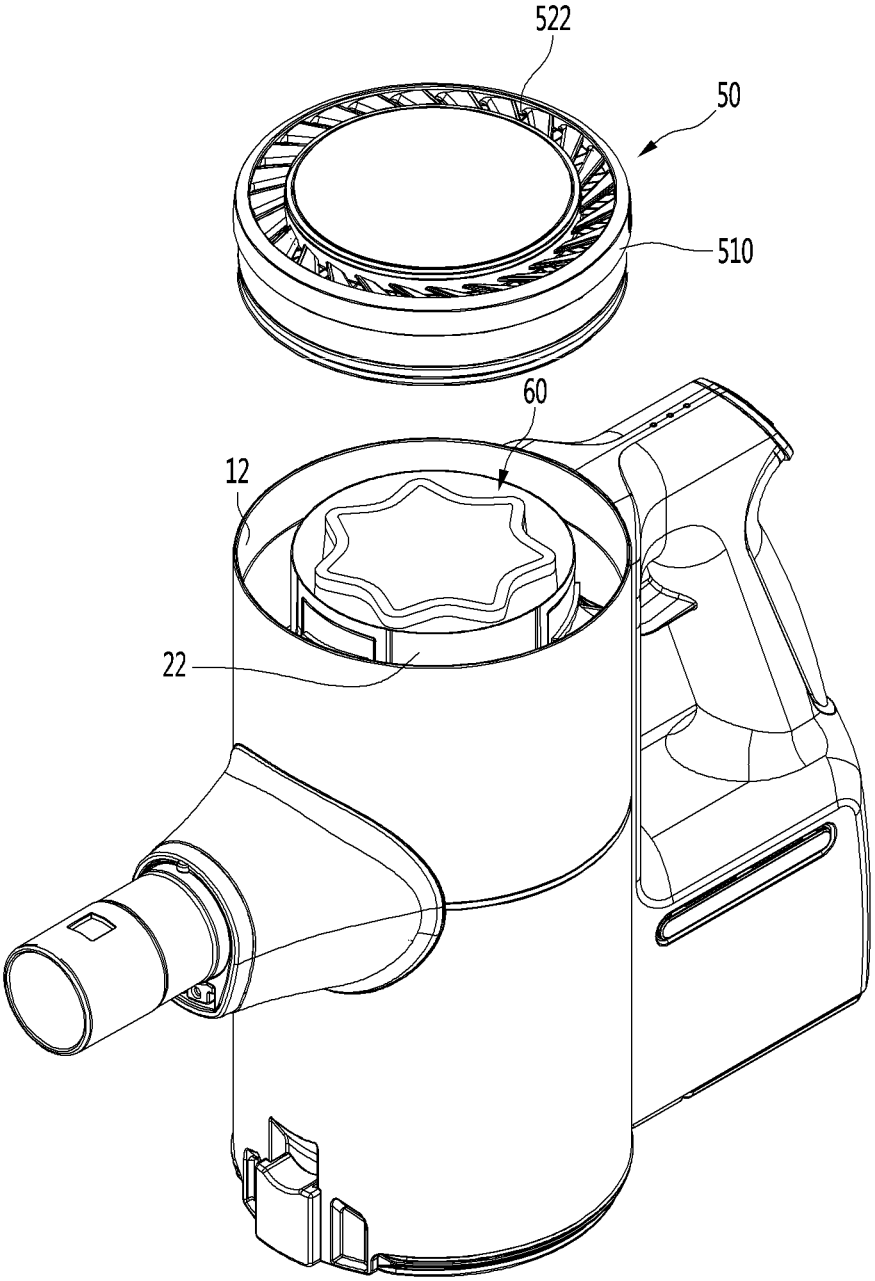
FIG. 4 is a view illustrating a state in which an opening cover is separated from a main body according to an embodiment.

FIG. 4 is a view illustrating a state in which an opening cover is separated from the main body according to an embodiment.

Referring to FIGS. 1 to 4, the cleaner 1 may further include an opening cover 50 having an air discharge hole 522 through which air is discharged. The air may be discharged through the air discharge hole 522 by driving the suction motor 20.

The opening cover 50 may be detachably coupled to an upper portion of the main body 2. In other words, the opening cover 50 may open and close an opening defined in an upper side of the main body 2.

For example, the opening cover 50 may be detachably coupled to the second body 12. In the state in which the opening cover 50 is coupled to the main body 2, a portion of the opening cover 50 is positioned outside the second body 12. Accordingly, a portion of the opening cover 50 is inserted in the main body 2 through an upper opening of the main body 2, and the other portion protrudes to the outside of the main body 2.

The height of the main body 2 may be substantially the same as the height of the handle 30. Accordingly, the opening cover 50 protrudes upward from the main body 2, so that a user easily separate the opening cover 50 from the main body 2 in the state of holding the opening cover 50.

The air discharge hole 522 may be defined in an upper portion of the opening cover 50. Accordingly, the air discharged from the suction motor 20 is discharged upward from the main body 2. According to this embodiment, it is possible to prevent the air discharged from the air discharge hole 522 from flowing to the user while the user cleans the bottom by using the cleaner 1.

The main body 2 may further include a filter mechanism 60 filtering the air discharged from the suction motor 20. In the state in which the opening cover 50 is separated from the main body 2, the filter mechanism 60 may be exposed to the outside.

The filter mechanism 60 may be disposed inside the flow guide 22. That is, the flow guide 22 may accommodate the filter mechanism 60.

For example, the filter mechanism 60 may be seated on the upper motor housing 26 to surround a portion of the upper motor housing 26. The upper motor housing 26 may include a filter support 261 supporting the filter mechanism 60. The filter support 261 and the motor housing may be called a filter mounting part. In other words, the filter mounting part may be disposed between the second body 12 and the suction motor 20.

When the filter mechanism 60 is supported by the filter support 261, the filter mechanism 60 may have a height that is approximately equal to or less than that of the main body 2. When the opening cover 50 is coupled to the main body 2, a bottom surface of the opening cover 50 and a top surface of the filter mechanism 60 may be spaced apart from each other. In other words, when the opening cover 50 is mounted on the main body 20, a predetermined space through which air flows may be defined between the opening cover 50 and the filter mechanism 60.

When the suction motor 20 is driven, the air discharged from the first and second cyclone units 110 and 130 be discharged to the outside via the first air passage 232 provided in the inner circumferential surface of the flow guide 22, the outer circumferential surface of the upper motor housing 26, and the third air passage 234 provided in the outer circumferential surface of the flow guide 22 and the inner circumferential surface of the second body 12. Here, the air flowing through the first air passage 232 may be primarily filtered by the filter mechanism 60.

<Detailed Configuration of Opening Cover 50>

The opening cover 50 may include a cover body 510 defining an outer appearance thereof. The cover body 510 may having an approximately cylindrical shape. The air discharge hole 522 including a plurality of openings may be defined in an upper portion of the cover body 510. The plurality of openings of the air discharge hole 522 may be arranged in a circumferential direction of the cover body 510.

The opening cover 50 may include an exhaust filter 512 for filtering dust contained in the air to be exhausted. For example, the exhaust filter 512 may include a high efficiency particulate air (HEPA) filter. The exhaust filter 512 may be disposed to surround the flow guide 22. In other words, for example, the exhaust filter 512 may have a ring shape. At least a portion of the flow guide may be disposed in a region defined by the exhaust filter 512. Thus, the cleaner 1 may be prevented from increasing in vertical length (height) when the opening cover 50 is coupled to the main body 20 to realize a more contact appearance of the cleaner 1.

An axis of a cyclone flow of the first cyclone unit 110 may pass through the exhaust filter 512 and the opening cover 50. For example, the axis of the cyclone flow may pass through a region defined by the exhaust filter 512. That is, the axis of the cyclone axis of the first cyclone unit 110 may pass through an opening of a center of the exhaust filter 512.

<Detailed Constituent of Filter Mechanism>

Figure 5:
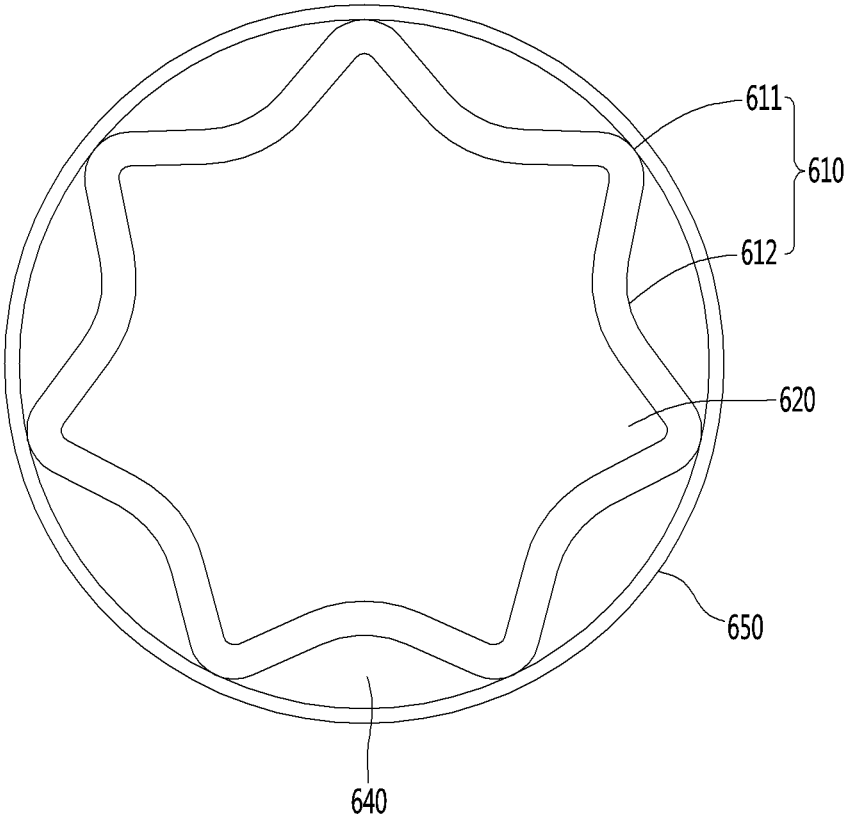
FIG. 5 is a top view of a filter mechanism according to an embodiment.
Figure 6:
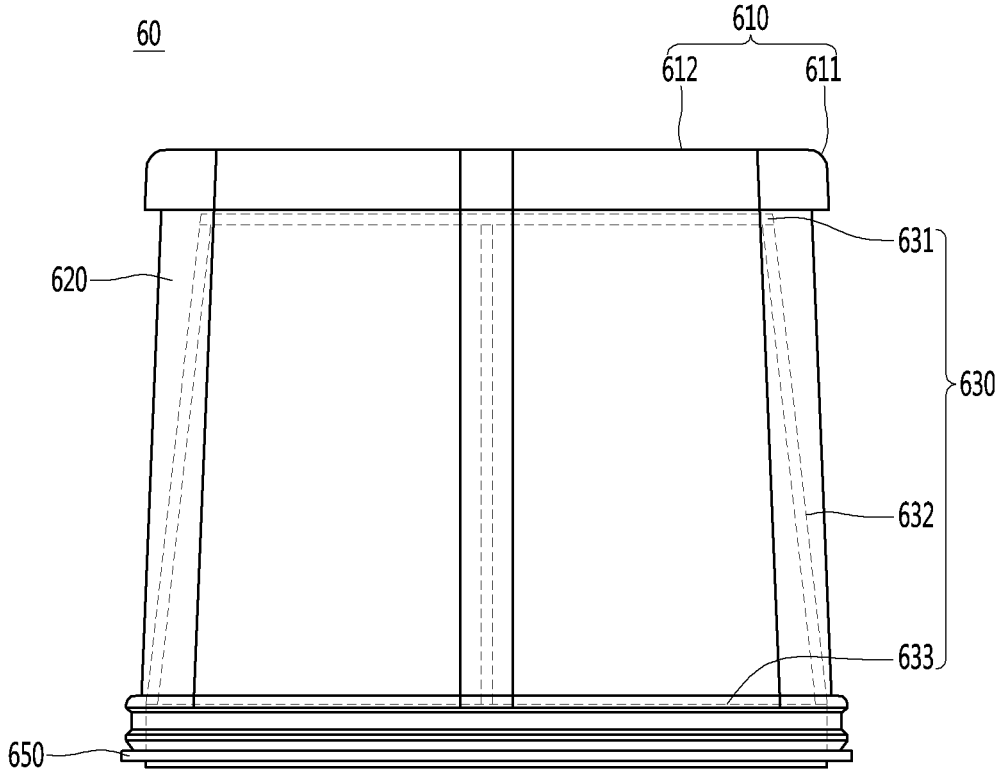
FIG. 6 is a front view of the filter mechanism according to an embodiment.
Figure 7:
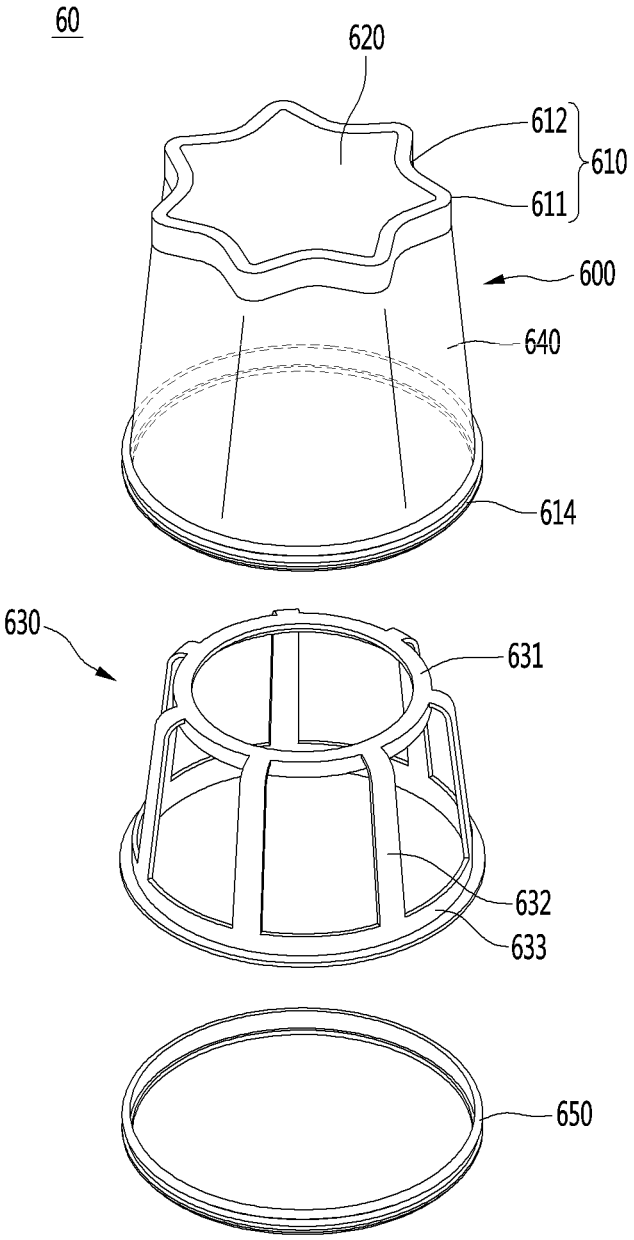
FIG. 7 is an exploded perspective view of the filter mechanism according to an embodiment.

FIG. 5 is a top view of the filter mechanism according to an embodiment, and FIG. 6 is a front view of the filter mechanism according to an embodiment. FIG. 7 is an exploded perspective view of the filter mechanism according to an embodiment.

Referring to FIGS. 5 and 7, the filter mechanism 60 may include a filter member 600. The filter member 600 may be disposed to surround at least a portion of the motor housing.

The filter member 600 may include an upper filter unit 620 (or a first filter unit). Also, the filter member 600 may further include an upper body 610 provided along a circumference of the upper filter unit 620.

The upper body 610 may have a polygonal ring shape, and the upper filter unit 620 may be disposed in an inner region of the upper body 610.

The upper filter unit 620 may be disposed to face one surface of the opening cover 50. Here, the one surface of the opening cover 50 may be a top surface part (see reference numeral 514 of FIG. 8) that will be described later. An extension line of the impeller 200 may pass through the upper filter unit 620 and the top surface part (see reference numeral 514 of FIG. 8).

The upper body 610 may have an unevenness shape in which a plurality of convex portions 611 and a plurality of concave portions 612 are alternately disposed in a horizontal direction. That is to say, the upper body 610 may have a loop shape that is bent several times in the horizontal direction.

For example, the upper body 610 may have a polygonal shape such as a triangular shape, a rectangular shape, a hexagonal shape, and the like.

The upper filter unit 620 may be made of a porous material to filter the dust contained in the air. For example, the upper filter unit 620 may include a meshfilter. The upper filter unit 620 may have a shape corresponding to the upper body 610. For example, when the upper body 610 has the hexagonal shape, the upper filter unit 620 may have a hexagonal shape.

The filter mechanism 60 may further include a side filter unit 640 (or a second filter unit). The side filter unit 640 may extend in a direction crossing the upper filter unit 620.

The side filter unit 640 may have an upper end connected to the upper body 610. Thus, the upper body 610 may serve as a connection body connecting the side filter unit 640 to the upper filter unit 620.

The side filter unit 640 may be disposed to face an inner circumferential surface of the flow guide 22.

Thus, the upper end of the side filter unit 640 may have a shape corresponding to the upper body 610. For example, when the upper body 610 has a heptagonal shape, the upper filter unit 640 may have a heptagonal shape.

The side filter unit 640 may be made of a porous material. For example, the side filter unit 620 may include a mesh-filter. For example, the side filter unit 640 may include materials of nylon and spun-bonded fabric. The spun-bonded fabric may be a kind of non-woven fabric produced by spinning a synthetic fiber such as polypropylene (PP) and then applying heat thereto. The polypropylene has a low fatigue property against bending. Also, the nylon has elasticity. Thus, when the side filter unit 640 is made of the materials such as the nylon and the polypropylene, a loss in durability of the side filter unit 640 due to the bending (or wrinkling) may be reduced. Also, the side filter unit 640 may be easily restored to its original shape even if the bending (or the wrinkling) occurs in at least a portion of the outer surface due to external force. In other words, the side filter unit 640 may be easily bent by the external force. Also, when external force is not applied to the side filter unit 640, the side filter unit 640 may be easily restored in its original shape.

The filter mechanism 60 may further include a filter fixing unit 680 coupled to a lower end of the side filter unit 640. The filter fixing unit 680 may have a diameter greater than that of the upper body 610.

That is, the filter mechanism 60 may have a bottom surface greater than a top surface thereof on an outer appearance thereof. In other words, the filter mechanism 60 may have an outer appearance that increases in cross-sectional area from the top surface to the bottom surface thereof.

The filter fixing unit 614 may be coupled to a lower end of the side filter unit 640 to prevent the outer appearance of the side filter unit 640 from being easily deformed.

The filter fixing unit 614 may have a circular ring shape of which an inner side is opened. Thus, the lower end of the side filter unit 640 may have an approximately circular shape by the filter fixing unit 614.

For example, the filter fixing unit 614 may be made of an elastic material. The filter fixing unit 614 may be seated on a filter frame 630 supporting the filter member 600.

The filter fixing unit 614 may be seated on the filter frame 630.

The filter mechanism 60 may further include the filter frame 630 supporting the filter member 600. At least a portion of the filter frame 630 may be accommodated in a space defined by the upper filter unit 620 and the side filter unit 640.

The filter frame 630 may prevent the outer appearances of the upper filter unit 620 and the side filter unit 640 from being easily deformed by the external force.

The filter frame 630 may include an upper frame 631 supporting the upper filter unit 620. The upper frame 631 may have a ring shape having an opening.

The filter frame 630 may further include a lower frame 633 spaced apart from the upper frame 631.

The filter fixing unit may be installed on the lower frame 633.

The filter frame 630 may further include a connection frame 632 connecting the upper frame 631 to the lower frame 633. The connection frame 632 may support an inner surface of the side filter unit 640.

The connection frame 632 may be provided in plurality. Also, the plurality of connection frames 632 may support the inner surface of the side filter unit 640 to prevent the side filter unit 640 from being easily deformed by the external force.

The connection frames 632 may be provided in number that is the same as that of the convex portions 611 of the upper body 610. Also, the connection frames 632 may be disposed at positions corresponding to the convex portions 611 of the upper body 610.

For example, when the upper frame 610 has a heptagonal shape having seven convex portions 611 and seven concave portions 612, each of the seven connection frames 632 may be disposed at the corresponding convex portion 611 to connect the upper frame 631 to the lower frame 633. Thus, even though external force is applied to the side surface of the filter mechanism 60, the side filter unit 640 may be prevented from being deformed in shape.

The filter mechanism 60 may further include a sealing member 650 inserted between the filter fixing unit 614 and the lower frame 633.

The sealing member 650 may have a circular ring shape having an opening.

Alternatively, when the lower frame 633 is closely attached to the filter fixing unit 614, the sealing member 650 may be omitted.

Figure 8:
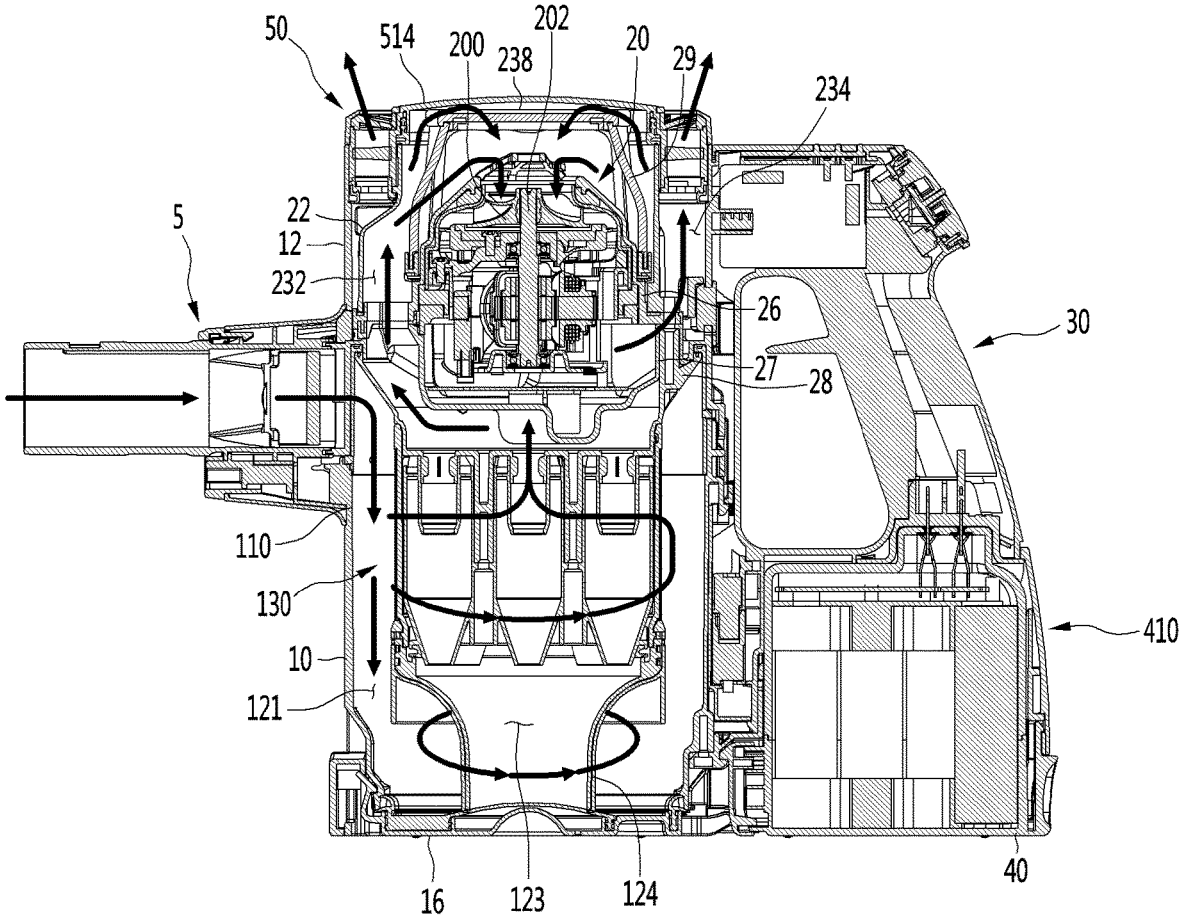
FIG. 8 is a view illustrating a flow of air within the cleaner according to an embodiment.
Figure 9:
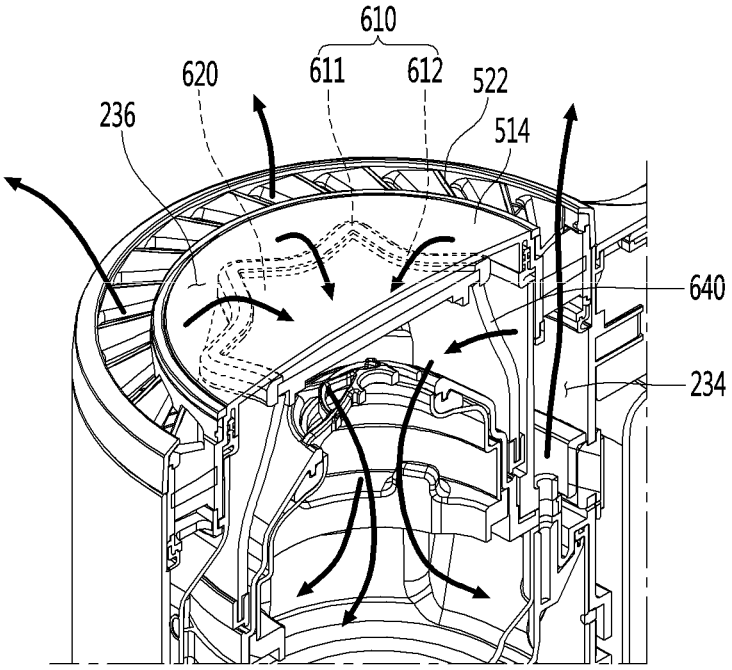
FIG. 9 is an enlarged perspective view illustrating a cross-section of the filter mechanism and an opening cover according to an embodiment.

FIG. 8 is a view illustrating a flow of air within the cleaner according to an embodiment, and FIG. 9 is an enlarged perspective view illustrating a cross-section of the filter mechanism and the opening cover according to an embodiment.

Referring to FIGS. 8 and 9, air and dust suctioned through the suction inlet 5 may be separated from each other while flowing along an inner surface of the first cyclone unit 110 by the operation of the suction motor 20.

The dust separated from the air may flow downward to be stored in the first dust storage part 121. The air separated from the dust may flow to the second cyclone unit 130. The air flowing to the second cyclone unit 130 may be separated again from the dust.

The dust separated from the air in the second cyclone unit 130 may flow downward to be stored in the second dust storage part 123. The air separated from the dust in the second cyclone unit 130 may be discharged from the second cyclone unit 130 to ascend toward the suction motor 20.

The air discharged from the second cyclone unit 130 may flow to the filter mechanism 60 along the first air passage 232 provided in the inner surface of the flow guide 22 and the outer surface of each of the motor housings 26 and 27. Also, the air containing the dust flowing to the filter mechanism 60 may be filtered by the upper filter unit 620 and the side filter unit 640 of the filter mechanism 60.

At least a portion of the top surface part 514 of the opening cover 50 may protrude in a direction that is away from the upper body 610.

In FIG. 8, at least a portion of the top surface part 514 may be rounded to protrude upward.

The upper body 610 may contact a bottom surface of the top surface part 514.

In this embodiment, since the upper body 610 has a non-circular shape, one portion of the upper body 610 may contact the top surface part 514, but the other portion may be spaced apart from the top surface part 514.

Also, since the upper filter unit 620 is disposed in the inner region of the upper body 610, a portion or whole of the upper filter unit 620 may be spaced apart from the top surface part 514.

Thus, the connection passage 236 between the top surface part 514 and the upper body 610 may be defined as a second air passage 238 between the top surface part 514 and the upper filter unit 620.

For example, since the upper body 610 includes the plurality of convex portions 611 and concave portions 612, the convex portions 611 may contact the bottom surface of the top surface part 514, but the concave portions 612 may be spaced apart from the bottom surface of the top surface part 514.

Thus, the concave portions 612 of the upper body 610 and the top surface part 514 may define the connection passage 236.

Thus, a portion of the air containing the dust flowing to the filter mechanism 60 may be filtered while passing through the side filter unit 640. Also, the other portion of the air containing the dust may ascend along a circumferential portion of the side filter unit 640 to flow to the second air passage 238 above the filter mechanism 60 through the connection passage 236.

Also, the containing the dust flowing to the second air passage 238 may be filtered by the upper filter unit 620.

In summary, the air containing the dust may be filtered by the side surface and top surface of the filter member 600. Thus, a filter area of the filter mechanism 60 may increase without changing the outer appearance of the main body 2 of the cleaner 1.

Furthermore, the area of the filter member, which is capable of accommodating foreign substances, may be sufficiently secured to reduce the phenomenon in which the dust is exhausted to the outside of the main body 2 of the cleaner 1. In addition, deterioration in suction performance of the cleaner 1 due to the accumulation of a cleaning time may be reduced.

The air passing through the side filter unit 640 and the upper filter unit 620 of the filter mechanism 60 may pass through the suction motor 20. The air may flow through the inside of the suction motor 20 by the impeller 200 and then flow to the second air passage 234 provided between the outer circumferential surface of the flow guide 2 and the inner circumferential surface of the second body 12. Also, the air flowing through the second air passage 234 may pass through the exhaust filter 512 provided in the cover body 510 and then be discharged to the outside through the air discharge hole 522.

Second Embodiment: Filter Mechanism 60 Having Circular Top Surface

A second embodiment will be described.

This embodiment is different from the foregoing embodiment in that the filer mechanism 60 has a circular top surface.

In this embodiment, for convenience of description, the same configuration as that of the previous embodiment is omitted, and the same reference numerals may be cited from those of the previous embodiment.

An upper body 610 of the filter mechanism 60 may have an approximately circular shape. Also, an upper filter unit 620 may have a shape corresponding to that of the upper body 610, i.e., a circular shape.

At least one protrusion may be disposed on a top surface of the upper body 610.

The at least one protrusion may contact a top surface part 514 of an opening cover 50.

Thus, other portions of the upper body 610 except for the protrusion may be spaced apart from the top surface part 514 of the opening cover 50 to provide a connection passage.

According to the proposed embodiments, the filter area may increase without changing the structure of the cleaner body.

That is, since a portion or whole of the upper filter unit is spaced apart from the top surface part of the opening cover, the air may be filtered by a side filter unit and an upper filter unit. In addition, a dust filtering area of the filter mechanism may increase to improve dust filtering efficiency.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a main body having an opening;

a suction motor accommodated in the main body and configured to generate suction force;

an opening cover separably coupled to the main body and configured to cover the opening;

a motor housing that surrounds the suction motor;

a flow guide that surrounds at least a portion of the motor housing and that is spaced apart from the motor housing; and a filter mechanism disposed between the motor housing and the flow guide, the filter mechanism comprising a filter member that surrounds the motor housing and that is configured to filter dust in introduced air in the cleaner, wherein the filter member comprises:

a first filter through which a first portion of the introduced air passes, and a second filter through which a second portion of the introduced air passes, the second filter extending in a direction that crosses the first filter.

2. The cleaner according to claim 1, wherein the first filter is disposed to face one surface of the opening cover, and wherein the second filter is disposed to face an inner circumferential surface of the flow guide.

3. The cleaner according to claim 2, wherein a first air passage through which air flows to the suction motor is provided between the motor housing and the flow guide, and a second air passage through which air flows is provided between the opening cover and the first filter.

4. The cleaner according to claim 3, further comprising an upper body to which the first filter and an upper portion of the second filter are connected, wherein one portion of the upper body contacts a top surface part of the opening cover, and another portion of the upper body is spaced apart from the top surface part of the opening cover, and wherein a spaced portion between the top surface part of the opening cover and the upper body defines a connection passage to connect the first air passage to the second air passage.

5. The cleaner according to claim 4, wherein the top surface part is disposed above the upper body and rounded to protrude in a direction that is away from the upper body.

6. The cleaner according to claim 4, wherein the upper body has a polygonal shape.

7. The cleaner according to claim 4, wherein the upper body has a shape in which a plurality of convex portions and a plurality of concave portions are alternately disposed in a horizontal direction.

8. The cleaner according to claim 7, wherein the filter mechanism further comprises a filter frame configured to support the filter member, and the filter frame comprises:

an upper frame configured to support the first filter;

a lower frame spaced apart from the upper frame; and a plurality of connection frames configured to connect the upper frame to the lower frame.

9. The cleaner according to claim 8, wherein a number of the plurality of connection frames is equal to a number of the plurality of convex portions.

10. The cleaner according to claim 4, wherein the upper body has a circular ring shape, and at least one protrusion is disposed on a top surface of the upper body to contact the top surface part.

11. The cleaner according to claim 4, wherein the filter member further comprises a filter connector connected to a lower portion of the second filter, and wherein the filter connector has a circular ring shape.

12. The cleaner according to claim 11, wherein the second filter has a cross-sectional area that gradually increases from the upper body to the filter connector.

13. The cleaner according to claim 1, wherein the filter mechanism further comprises a filter frame configured to support the filter member, and the filter frame comprises:

an upper frame configured to support the first filter;

a lower frame spaced apart from the upper frame; and a connection frame configured to connect the upper frame to the lower frame.

14. The cleaner according to claim 13, wherein the lower frame is seated on the motor housing.

15. The cleaner according to claim 13, wherein the filter member further comprises a filter connector connected to a lower portion of the second filter, and wherein the filter connector is seated on the lower frame.

16. A cleaner comprising:

a main body having an opening;

a suction motor accommodated in the main body and configured to generate suction force;

an opening cover separably coupled to the main body and configured to cover the opening;

a motor housing configured to surround the suction motor; and a filter member configured to filter dust in air flowing to the suction motor, wherein the filter member comprises:

an upper body having a central opening, an upper filter through which a first portion of the air passes, the upper filter being disposed on the central opening of the upper body, and a side filter through which a second portion of the air passes, the side filter being connected to a lower portion of the upper body, wherein the opening cover comprises a top surface part facing the upper filter, and wherein at least a portion of the upper body is spaced apart from the top surface part, and the upper filter is spaced apart from the top surface part.

17. The cleaner according to claim 16, wherein the side filter surrounds the motor housing.

18. The cleaner according to claim 16, wherein the suction motor comprises an impeller, and wherein an extension line of the impeller passes through the upper filter and the top surface part.

19. The cleaner according to claim 16, further comprising a flow guide that surrounds the side filter.

20. The cleaner according to claim 16, wherein the top surface part gradually protrudes upward, and wherein the upper body has a non-circular shape.

* * * * *